US005747895A

United States Patent [19]

Minassian

[11] Patent Number: 5,747,895

[45] Date of Patent: May 5, 1998

[54] SYSTEM FOR TEMPORARILY PRESERVING SIGNAL-FLOW AROUND A SIGNAL SWITCH

[75] Inventor: Aram Minassian, Watertown, Mass.

[73] Assignee: United Electric Controls Company, Watertown, Mass.

[21] Appl. No.: 476,639

[22] Filed: Jun. 7, 1995

[51] Int. Cl.[6] ..... H01H 35/18

[52] U.S. Cl. ..... 307/118

[58] Field of Search ..... 307/116, 115, 307/113, 117, 118, 125, 131, 139, 140, 141.4; 361/195, 2, 3, 13; 310/68 C

[56] References Cited

U.S. PATENT DOCUMENTS

| | | | |
|---|---|---|---|
| 3,651,371 | 3/1972 | Tingley | 315/102 |
| 4,040,042 | 8/1977 | Mayer | 340/239 |
| 4,251,845 | 2/1981 | Hancock | 361/8 |
| 4,438,472 | 3/1984 | Woodworth | 361/13 |
| 5,467,245 | 11/1995 | Newbould | 361/170 |

*Primary Examiner*—William M. Shoop, Jr.
*Assistant Examiner*—Kim Lockett
*Attorney, Agent, or Firm*—Wolf, Greenfield & Sacks P.C.

[57] ABSTRACT

A system for temporarily preserving the signal-flow to a device when a signal switch has been tripped. The system includes a time-delay relay connected in parallel with the switch. When the switch is tripped, breaking the signal-flow through the switch, the time-delay relay is energized for a set period of time to maintain the signal-flow to the device. The condition which will trip the switch and the amount of time during which the time-delay relay will preserve signal-flow will vary depending upon the particular application. During the set period of time, the switch has an opportunity to recover from the condition which originally tripped the switch and resume signal flow through the switch. If the switch tripping condition persists for longer than the set period, then signal-flow to the device is interrupted after the set period of time expires. The system minimizes unnecessary interruptions in signal-flow when the switch has been accidentally or unintentionally tripped.

17 Claims, 2 Drawing Sheets

SYSTEM FOR TEMPORARILY PRESERVING SIGNAL-FLOW AROUND A SIGNAL SWITCH

FIELD OF THE INVENTION

This invention relates generally to a system for a signal switch and more specifically to a system for temporarily preserving signal-flow around a signal switch when the signal-flow through the switch is momentarily interrupted.

BACKGROUND OF THE INVENTION

Signal switches are designed to break a connection when a specified condition is detected. This interruption in signal-flow through the signal switch often triggers an alarm or shuts down the device or system connected to the signal switch.

Each signal switch is built to detect a specified condition. For example, pressure switches are used to detect when a specified pressure has been reached in a device or system, temperature switches are used to detect when a specified temperature has been reached in a device or system, centrifugal switches are used to detect when a predetermined operating speed has been reached in a motor, and limit switches are used to detect when the proper level has been reached in an elevator. In each of these examples, when the specified condition is detected the connection through the switch is broken, interrupting signal flow.

Although signal switches are fairly reliable, errors in detecting the specified conditions are known to occur. The errors often occur because signal switches have difficulty in discerning between the actual occurrence of a specified condition and the occurrence of another situation which, to the switch, has the same effect as if the specified condition had occurred. When these errors arise, unnecessary alarm conditions or circuit shut downs are often initiated.

Naval shipboard applications provide one specific setting in which such errors may occur. Naval ships use pressure switches in a variety of on-board applications. Each switch is designed to break the connection through the switch when an excessive pressure is detected. Unfortunately, signal-flow through these switches may be interrupted even when an excessive pressure has not been detected. The naval ships, on which these switches are located, occasionally experience severe shocks or heavy vibrations. The pressure switches are sometimes jarred open by these shocks or vibrations, initiating unnecessary shut downs or alarm conditions.

Efforts to minimize or eliminate the problems with the use of signal switches in these applications have focussed primarily on improvements with the signal switch. However, modifications to improve the ability of signal switches (such as pressure switches) to detect the occurrence of the specified condition have had limited success.

It is therefore an object of the present invention to provide a system for minimizing the unnecessary interruption of signal-flow to a device or system due to false interruption of a signal-flow through a signal switch.

Other objects and advantages will become apparent from the following detailed description.

SUMMARY OF THE INVENTION

To achieve the foregoing object, a signal switch and a time-delay relay are connected in parallel. When the switch detects a specified condition, signal flow through the switch is interrupted and the time-delay relay is energized for a set time period, after which it will deenergize itself. During this set time period, the time-delay relay temporarily maintains the signal-flow originally passing through the switch. If during the set time period the condition causing the interruption in signal flow does not persist, then the switch resumes its normal operating condition. At first, partial signal-flow through the switch resumes, followed by full signal flow when the time-delay relay deenergizes and opens. If the interruption in signal-flow through the switch persists, all signal-flow is terminated once the set period of time has expired.

BRIEF DESCRIPTION OF THE DRAWINGS

The objects, advantages and features of this invention will be more clearly appreciated from the following detailed description when taken in conjunction with the accompanying drawings, in which.

DETAILED DESCRIPTION

Figure 1:
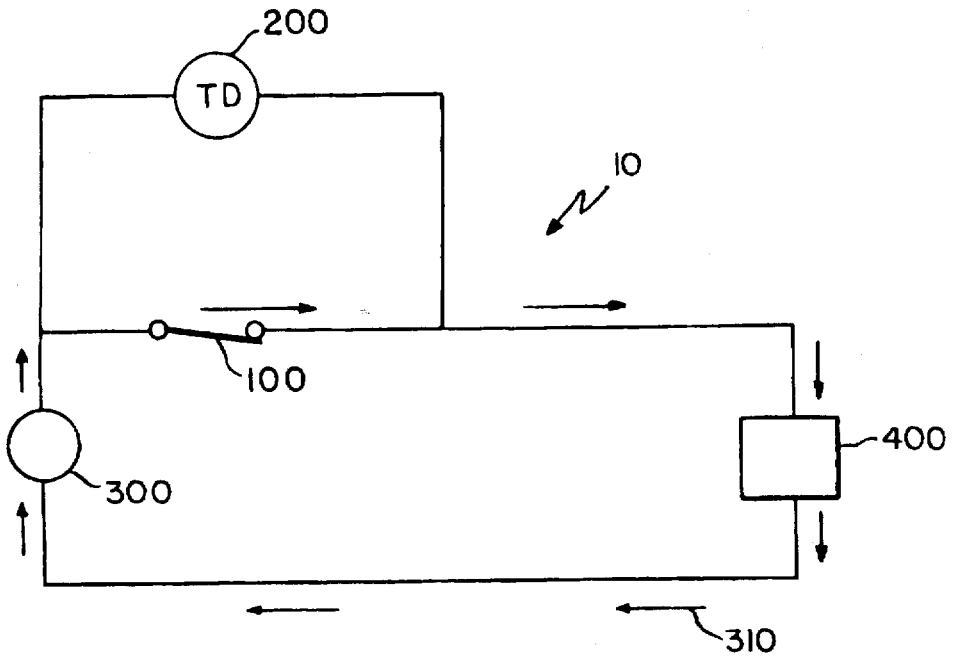
FIG. 1 is a block diagram of the system with the signal switch in a normally closed position.
Figure 2:
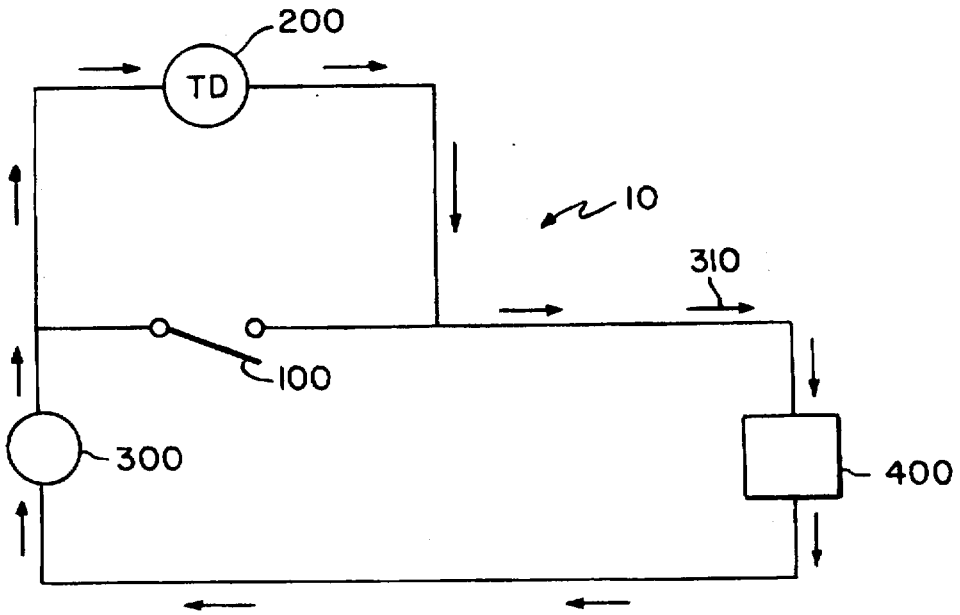
FIG. 2 is a block diagram of the system shown in FIG. 1 with the signal switch in an open position and the time-delay relay energized.

FIGS. 1 and 2 disclose block diagrams of a system 10 for temporarily preserving signal-flow around a signal switch 100. The system 10 minimizes or eliminates unnecessary interruptions in signal-flow to a device 400 when the signal switch 100 has been erroneously tripped.

More specifically, FIG. 1 shows the system 10 with the signal switch 100 in a normally closed position and connected in parallel with a time-delay relay 200. Current signal-flow (shown in phantom by the arrows 310) passes through the signal switch 100 to the device 400. Signal-flow does not pass through the time-delay relay 200, which remains deenergized while the signal switch 100 is closed. Power is provided to the system 10 by a power source 300.

The signal switch 100 is designed to open when a triggering condition is detected. As discussed earlier, a wide range of specified conditions could be the triggering condition. For example, the specified condition could be a certain pressure limit, temperature limit, motor-speed limit, or level limit. Unfortunately, as also discussed earlier, the signal switch 100 may be unable to discriminate between the specified and an unspecified condition which can cause false triggering of the switch. Thus, the false triggering condition for the signal switch 100 will result in an unnecessary and undesired interruption in signal-flow.

FIG. 2 shows the same system 10 disclosed in FIG. 1, except that the signal switch 100 is now open and the time-delay relay 200 has been energized for a set period of time. The signal switch 100 has been tripped open by a triggering condition (either false or intended). Opening the signal switch 100 energizes the time-delay relay 200. During the set period of time, signal-flow (shown in phantom by the arrows) passes through the energized time-delay relay 200 to the device 400. Signal-flow does not pass through the open signal switch 100.

The signal switch 100 remains open, interrupting signal-flow through the signal switch 100, as long as the triggering condition is still detected. If during the set period of time the signal switch 100 ceases to detect the triggering condition, then the signal switch 100 closes. When the signal switch 100 closes, the time-delay relay 200 is deenergized. Signal-flow passes through the signal switch 100 again and does not pass through the time-delay relay 200. During this entire time, the device 400 does not experience any interruption in signal-flow. If during the set period of time the signal switch 100 continues to detect the triggering condition, then the signal switch 100 remains open. After the set period of time expires, signal-flow through the time-delay relay 200 is interrupted.

The system 10 provides the signal switch 100 with an opportunity to discriminate between an intended and an unintended triggering condition. The most common unintended condition which interferes with the proper operation of the signal switch 100 for each particular application is usually known. Additionally, the duration of the unintended condition is also known and is usually shorter than the duration of the intended condition. For the system 10, the duration the time-delay relay 200 stays closed is selected to be longer than the expected duration of the unintended condition. If an unintended condition is the triggering condition, the unintended condition will stop before the time-delay relay 200 opens. This provides the signal switch 100 with an opportunity to recover from the false triggering and close before the set period of time expires. Once signal switch 100 recovers, signal-flow will resume through the signal switch 100. Meanwhile, signal-flow through the time-delay relay 200 will be interrupted and the time-delay relay 200 will be deenergized. If an intended condition is the triggering condition, then signal-flow to the device 400 will be interrupted when the time-delay relay 200 opens. Thus, the system 10 provides the signal switch 100 an opportunity to verify the detection of the intended condition while still protecting the device 400 by interrupting signal-flow after a set period of time when a specified condition is detected.

Figure 3:
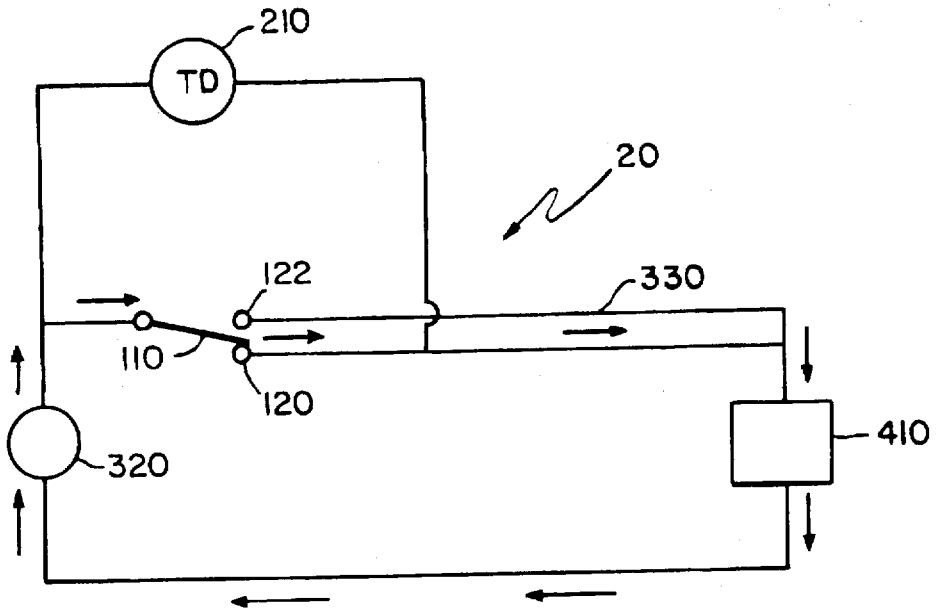
FIG. 3 is a block diagram of the system with a signal switch in a normally closed position.

Another embodiment of the present embodiment will now be described with particular reference to FIGS. 3 and 4 which disclose block diagrams of a system 20 which temporarily preserves signal-flow around a signal switch 110. Signal switch 110 has two poles, pole 120 and pole 122, both of which are coupled to a device 410. Switch 110 is in a normally closed position, when it is coupled to pole 120, as shown in FIG. 3. As with the embodiment of FIGS. 1 and 2, time-delay relay 210 is connected in parallel with the normally closed side of switch 210, or with pole 120. Signal flow (shown in phantom by arrows 330) from power source 320 passes through signal switch 110 to the device 410. Signal-flow does not pass through the time-delay relay 210, which remains deenergized while the signal switch 110 is in its normally closed position.

Signal switch 110 is designed to disconnect from pole 120 when a triggering condition is detected. Typically, neither pole 120 nor pole 122 would be connected during a triggering condition, and the switch would float between the two poles.

Figure 4:
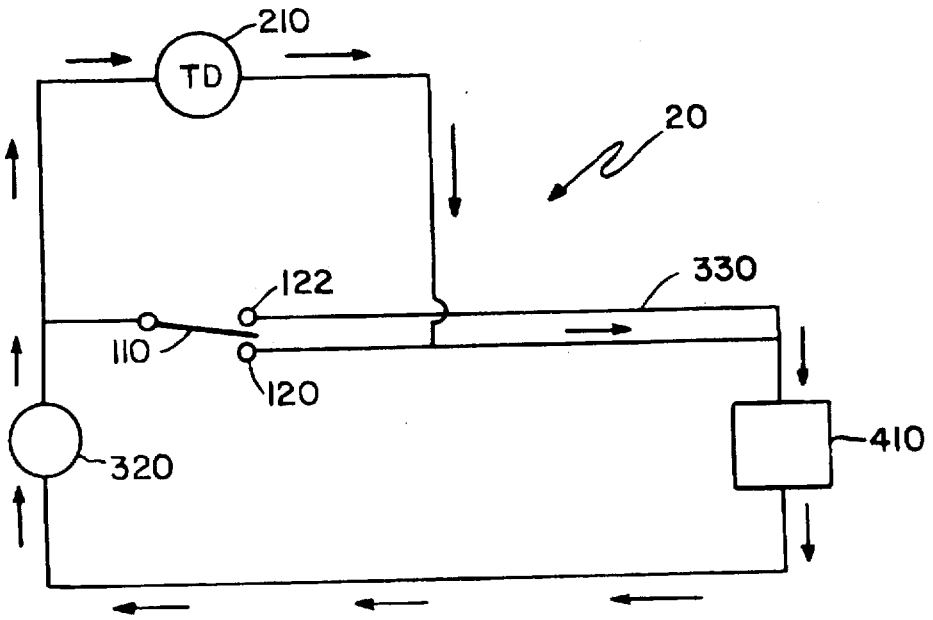
FIG. 4 is a block diagram of the system shown in FIG. 3 with a signal-flow through the signal switch interrupted and the time-delay relay energized.

FIG. 4 shows the same system 20 as disclosed in FIG. 3 except that signal switch 110 is no longer in its normally closed condition, and switch 110 is floating between poles 120 and 122. Signal switch 110 has been tripped either by a false or an intended triggering condition. The opening of signal switch 110 energizes time-delay relay 210 for a set period of time, and during this period of time, signal-flow (shown in phantom by arrows 330) passes through the energized time-delay relay 210 to device 410. Signal switch 110 remains in this float position, interrupting the signal-flow through switch 110, so long as the triggering condition is still detected. As with the embodiment of FIGS. 1 and 2, if during the set period of time signal switch 110 ceases to detect a triggering condition, signal switch 110 returns to its normally closed condition in contact with pole 120. When switch 110 returns to its normally closed condition, time-delay relay 210 is deenergized, and signal-flow passes through signal switch 110 and not through time-delay relay 210. After the set period of time expires, signal-flow through the time-delay relay 210 is interrupted. If after the set period of time expires, signal switch 110 continues to detect the triggering condition, signal switch 110 remains in its float condition, and all signal-flow to device 410 is interrupted.

Systems 10 and 20 can be used to avoid the previously disclosed problems in naval shipboard applications. In those applications, the pressure switches are designed to be interrupted when excessive pressures are detected, however the switches are also subject to interruption when the ship experiences severe shocks or heavy vibrations. The excessive pressures are known to last for more than one second, while the severe shocks or heavy vibrations last less than one second. By using a time-delay relay 200 or 210 rated for a one second delay in the system 10 or 20, the switch 100 or 110 has an opportunity to verify that the triggering condition is an excessive pressure and not severe shocks or heavy vibrations. If the switch 100 or 110 remains interrupted after one second, then signal flow to the device 400 or 410 is interrupted.

In the particular application described above, a pressure switch was used as the signal switch 100 or 110. However, any type of signal switch 100 or 110 may be used. For example, the signal switch 100 or 110 could be a temperature, centrifugal, or limit switch. The system 10 or 20 may also be used with any type of device 400 or 410, such as an elevator or a computer.

Similarly, even though a time-delay relay 200 or 210 with a one second delay was shown, any type of time-delay relay could be used. The time-delay relay 200 or 210, selected for use in the system 10 or 20 will depend upon the duration of the unintended condition which is anticipated in each particular application. Relay 200 or 210 could include apparatus to adjust the time delay for a given application or triggering condition, or the time delay of relay 200 or 210 could be fixed.

Having thus described the basic concept of the invention, it will be readily apparent to those skilled in the art that the foregoing detailed disclosure is intended to be presented by way of example only, and is not limiting. Various alterations, improvements, and modifications will occur to those skilled in the art, though not expressly stated herein. These modifications, alterations, and improvements are intended to be suggested hereby, and are within the spirit and scope of the invention. Accordingly, the invention is limited only by the following claims and equivalents thereto.

What is claimed is:

1. A system for temporarily preserving a signal-flow to a device, the system comprising:

a power supply;

a switch for normally connecting the device to said power supply, said switch opening and interrupting a connection between said power supply and the device upon an occurrence of a triggering condition; and a time-delay relay connected in parallel with said switch and configured to be energized for a set period of time to preserve signal-flow from the power supply to the device when the connection between said power supply and the device is interrupted when said switch disconnects the power supply from the device;

the set period of time having a predetermined length whereby, when the switch disconnects the power supply from the device for at least an entire length of the set period of time, the time-delay relay will de-energize at an end of the set period of time thereby disconnecting the power supply from the device; and if the triggering condition ceases prior to the end of the set period of time, the switch will close and the time-delay relay will de-energize thereby allowing signal flow from the power supply to the device without any interruption.

2. The system as set forth in claim 1 wherein said switch is a pressure detecting switch.

3. The system as set forth in claim 1 wherein said switch is in a normally closed condition when said power supply is connected to the device through said switch.

4. The system as set forth in claim 1 wherein said relay includes means for adjusting the set period of time.

5. A system for pressure control applications to minimize unnecessary interruptions of signal-flow from a power supply to a device, the system comprising:

a pressure detecting switch which normally connects the device to the power supply until an occurrence of a triggering condition causes the switch to open and interrupt the connection between the device and the power supply; and a time-delay relay connected in parallel with said switch and configured to be energized for a set period of time to maintain signal-flow from the power supply to the device when the connection between the power supply and the device is interrupted when said switch disconnects the device from the power supply;

the set period of time having a predetermined length whereby, when the pressure detecting switch disconnects the power supply from the device for at least an entire length of the set period of time, the time-delay relay will de-energize at an end of the set period of time thereby disconnecting the power supply from the device; and if the triggering condition ceases prior to the end of the set period of time, the pressure detecting switch will close and the time-delay relay will de-energize thereby allowing signal-flow from the power supply to the device without any interruption.

6. The system as set forth in claim 5 wherein the period of time is adjustable.

7. The system as set forth in claim 5 wherein the period of time is fixed.

8. A fault-tolerant switching system for temporarily preserving signal-flow to a device, the system comprising:

a switch of a normally closed type including an input terminal and an output terminal normally connected to one another by the switch, the switch opening the connection between the input and output terminals upon an occurrence of a triggering condition; and a normally open time-delay relay having a predetermined time delay period and having a relay input terminal connected to the input terminal of the switch and a relay output terminal connected to the output terminal of the switch, the relay configured to be energized so as to connect the relay input and output terminals to one another for the predetermined time delay period whenever the connection between the switch input and output terminals is interrupted by the switch;

the predetermined time delay period having a length whereby, when the switch disconnects its input and output terminals from one another for at least an entire length of the predetermined time delay period, the time-delay relay will de-energize at an end of the predetermined time-delay period thereby disconnecting the relay input and output terminals from one another; and if the triggering condition ceases prior to the end of the predetermined time-delay period, the switch will close and reconnect its input and output terminals to one another and the time-delay relay will de-energize.

9. The system as set forth in claim 8 wherein the switch is a pressure detecting switch.

10. The system as set forth in claim 8 wherein the predetermined period of time is sufficient to filter out transient occurrences of the condition.

11. The system as set forth in claim 9, wherein the predetermined period of time is fixed at a preset value.

12. The system as set forth in claim 9, wherein the predetermined period of time is adjustable.

13. A method for minimizing unnecessary interruption of a signal flow from a power source connected through a normally-closed condition detecting switch to a device when the switch is caused to open and thereby disconnect the power source from the device due to an occurrence of a triggering condition, the method comprising steps of:

connecting a normally open time-delay relay in parallel with the condition detecting switch;

setting the time-delay relay to be energized so as to remain closed for a set period of time to preserve signal flow from the power source to the device when the connection therebetween is interrupted by the switch; and connecting the power source to the device through the time-delay relay for the set period of time when the condition detecting switch disconnects the power source from the device;

whereby, when the condition detecting switch disconnects the power source from the device for at least an entire length of the set period of time, the time-delay relay will de-energize at an end of the set period of time thereby disconnecting the power source from the device; and if the triggering condition ceases prior to the end of the set period of time, the condition detecting switch will close and the time-delay relay will de-energize thereby allowing signal flow from the power source to the device without interruption.

14. The method as recited in claim 13, wherein the first type is vibration or shock; and the second type is a change in pressure.

15. The system as set forth in claim 2, wherein:

the intended triggering condition is a change in pressure; and the unintended condition is shock or vibration.

16. The system as recited in claim 5, wherein:

the intended triggering pressure condition is a change in pressure; and the unintended condition is shock or vibration.

17. The system as recited in claim 8, wherein:

the intended condition is a change in pressure; and the unintended condition is shock or vibration.

* * * * *